US009933151B2

(12) United States Patent
Xiangang

(10) Patent No.: US 9,933,151 B2
(45) Date of Patent: Apr. 3, 2018

(54) BASKETBALL STANDS LIGHTING SYSTEM

(71) Applicant: Mega Slam Hoops, LLC, San Antonio, TX (US)

(72) Inventor: Zhang Xiangang, Shan Dong (CN)

(73) Assignee: Mega Slam Hoops, LLC, San Antonio, TX (US)

( * ) Notice: Subject to any disclaimer, the term of this patent is extended or adjusted under 35 U.S.C. 154(b) by 0 days.

(21) Appl. No.: 15/380,354

(22) Filed: Dec. 15, 2016

(65) Prior Publication Data

US 2017/0191652 A1 Jul. 6, 2017

(30) Foreign Application Priority Data

Dec. 16, 2015 (CN) ..... 2015 2 1042371 U

(51) Int. Cl.

| | |
|---|---|
| ***A63B 63/08*** | (2006.01) |
| ***A63B 71/00*** | (2006.01) |
| ***F21V 33/00*** | (2006.01) |
| ***F21S 8/08*** | (2006.01) |
| *F21W 131/10* | (2006.01) |

(52) U.S. Cl.

CPC ..... *F21V 33/008* (2013.01); *A63B 63/083* (2013.01); *F21S 8/086* (2013.01); *F21W 2131/10* (2013.01)

(58) Field of Classification Search

CPC ..... F21V 33/008; A63B 63/083; F21S 8/086; F21W 2131/10

See application file for complete search history.

(56) References Cited

U.S. PATENT DOCUMENTS

| | | | | |
|---|---|---|---|---|
| 8,845,151 | B1 * | 9/2014 | Hale | A63B 63/083 362/235 |
| 8,967,830 | B1 * | 3/2015 | Winfrey | F21V 21/116 362/145 |
| 2007/0297165 | A1 * | 12/2007 | Watson | A63B 63/083 362/145 |
| 2017/0128804 | A1 * | 5/2017 | Bruce | A63B 63/083 |

* cited by examiner

*Primary Examiner* — Tracie Y Green

(57) ABSTRACT

The present invention relates to a basketball stand lighting system comprising a fixing seat connected to a U-shaped supporting structure, a main stand, an inclined support frame, a telescopic frame outer pipe, a telescopic frame inner pipe, a lower fixing plate, a light, a lower support, and a column. This basketball stand lighting system allows convenient installation by using the basketball stand's own backboard height adjustment system to adjust the height of the installed lighting system, so there is no dangerous high altitude operation. The lighting system uses the basketball stand's own backboard height adjustment system to ensure that the installation is fixed in place. The lighting system saves time and labor, and the structure is ingenious and simple. This basketball stand lighting system need not employ complicated installation auxiliary equipment, and it has reduced time used when the equipment is loaded and unloaded.

16 Claims, 5 Drawing Sheets

BASKETBALL STANDS LIGHTING SYSTEM

CROSS-REFERENCE TO RELATED APPLICATIONS

This application claims the benefit of Chinese Patent Application having Serial No. CN201521042371.2, which was filed Dec. 16, 2015. This priority application is hereby incorporated by reference in its entirety into the present application to the extent consistent with the present application.

TECHNICAL FIELD

The utility model relates to a site of sports equipment, and more specifically to a basketball frame lighting system.

BACKGROUND ART

Currently, basketball courts can rely on natural light only, and there is no professional basketball lighting device and system to control the light source. When the light is not good this is a problem for the athletes, and at the same time will also affect vision of the audience viewing the game. The basketball court, with a large-scale lighting system may have inconvenient installation and a need to increase the auxiliary installation personnel. The installation the procedure is tedious, installation is difficult for personnel, and the maintenance cost is high.

SUMMARY OF THE INVENTION

The purpose of the present invention is to provide a kind of time and labor saving lighting system, which also has a simple and ingenious structure.

In order to solve the technical problems, the purpose of the present invention is realized through the following technical scheme:

A basketball support lighting system comprising a fixing seat, a U-shaped supporting structure, a main stand, an inclined supporting frame, a telescopic frame outer tube, an inner tube of the telescopic racks, a lower fixing plate, a lighting lamp, an upright post, and a lower support;

The fixing seat is connected with two U-shaped supporting structures and a column through the lower fixing plate. The fixed base is connected to the lower fixed plate. The upper end of the telescopic frame outer pipe is connected with the telescopic frame inner pipe and the frame. The lower end of the telescopic frame outer pipe is connected with the lower support and the inclined supporting frame. The lighting lamp is fixedly connected to the front end of the main stand.

The telescopic frame inner pipe and the main stand are connected with the twelfth pin connection, so the main stand and the telescopic frame inner pipe can be moved.

The telescopic frame outer tube and the telescopic frame inner pipe are connected with the eighth pin connection, so the telescopic frame outer pipe and the telescopic frame inner pipe can slide.

The inclined supporting frame is connected with the lower support through the cushion, so that the inclined support frame and the lower support can be moved.

The frame and a lower fixed plate are connected with a M12X25 hex-head bolt.

The fixing seat and the main stand are connected with a M12X110 hex-head bolt.

The inclined supporting frame and the telescopic frame outer pipe are connected with a M10X60 hex-head bolt.

The frame and the illuminating lamp form the entire basketball stand with the installed lighting system.

The M12X110 hex-head bolt as a fixed point, to be based on the structural features according to the matrix, is a reasonable choice of the position point to ensure the highest position of the lighting system, and that the lowest position of the lighting system does not interfere with other parts. The M12x110 hex-head bolt as a fixed point can make reasonable use of the installation space and optimize the structure characteristic.

The M10X60 hex-head bolt is an inclined supporting point. The M10X60 hex-hold bolt, the sloping support frame, and the telescopic frame outer tube as a retractable frame inner pipe inclined supporting of the telescopic rod structure, are connected to the upright post. The inclined supporting point selection on the adjustable basketball support of the lower support frame may not damage the product structure, the connection mode, and the protection of the contact surface in the upright bumper.

The sloping may support the other end of the quick connection and installation of a lighting system, so that the inclined support can be quickly assembled and disassembled, without destroying the original structure and appearance of the products.

The inclined supporting telescopic rod structure may have a fast insertion manner to determine its length in order to adapt to the needs of the different products, so a basketball support lighting system can be used in a variety of products using the same product structure.

The U-shaped supporting structure, the fixing seat, and the lower fixing plate are connected to the upper and lower ends of the main stand, using two perpendicular directions for locking the connection. In order to consider the strength and stability after installation, the lower end of the lighting mount system uses two perpendicular directions for locking the connection, effectively preventing it from shaking front and back and left and right.

The beneficial effects of the present invention are:

1. convenient installation: using its own basketball backboard height adjustment system, so the installed lighting mounting system easily moves to the required mounting position through the necessary fixed connection and the support. It is time saving, labor saving, and there is no dangerous high altitude operation.
2. the adjustment is convenient: using the basketball backboard height adjustment system, it allows installation that is easy, quick, and convenient. Maintenance of the facilities is also convenient.
3. fixing is convenient: using the basketball backboard height adjustment system in the final installation allows fine tuning that is convenient and quick.

The basketball stand lighting system is obviously different from the structure of prior lamp bracket. The installation efficiency doubled from the original installation using more than three people to using two people to assemble, and it is time-saving and labor-saving. The lighting system uses a basketball structure without adding auxiliary installation personnel like the traditional structure. The lighting system simplifies the installing and operating procedures, reduces the number of installation personnel, and reduces the installation cost of the key vendors.

DETAILED DESCRIPTION

Figure 1:
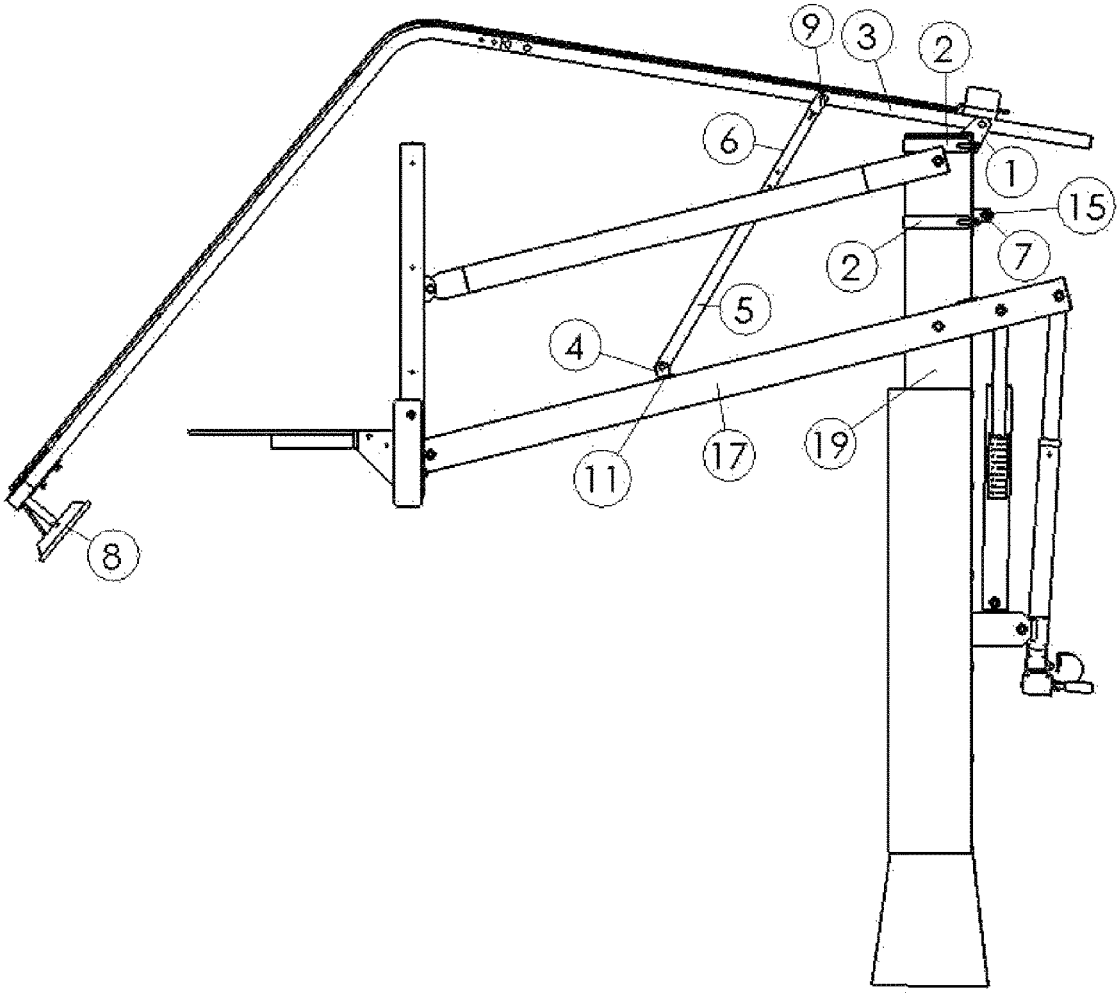
FIG. 1 is the structure diagram of the basketball stand lighting system.

It is to be understood that the following disclosure describes several exemplary embodiments for implementing different features, structures, or functions of the present disclosure. Exemplary embodiments of components, arrangements, and configurations are described below to simplify the present disclosure; however, these exemplary embodiments are provided merely as examples and are not intended to limit the scope of the present disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and the claims to refer to particular components. As one skilled in the art will appreciate, various entities may refer to the same component by different names, and as such, the naming convention for the elements described herein is not intended to limit the scope of the present disclosure, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

As shown in FIG. 1, the basketball support lighting system may include a fixing seat 1, a U-shaped supporting structure 2, a main stand 3, an inclined supporting frame 4, a telescopic frame outer pipe 5, a telescopic frame inner pipe 6, a lower fixing plate 7, a lamp 8, a lower support 17, and an upright post 19.

The fixing seat 1 may be connected with a M12 nylon cap 12 and a twelfth gasket 14 to two U-shaped supporting structures 2 and the upright post 19. The upper end of the main stand 3 may be connected with a M12X110 hex-head bolt 16 and a M12 nylon cap 12 to the fixing seat 1. The lower end of the main stand 3 may be connected with a M12X25 hex-head bolt 15 and a M12 nylon cap 12 to the fixing seat 1 and then with the upright post 19. The telescopic frame outer pipe 5 and the telescopic frame inner pipe 6 may be connected together. The telescopic frame inner pipe 6 and the upper end of the main stand 3 may be connected with the telescopic frame outer pipe 5 and the lower end of the inclined support frame 4 using a M10X60 hex-head bolt 18 and a M10 nylon cap 13 to connect to the lower support 17. The lamp 8 may be connected to the front end of the main stand 3.

Figure 2:
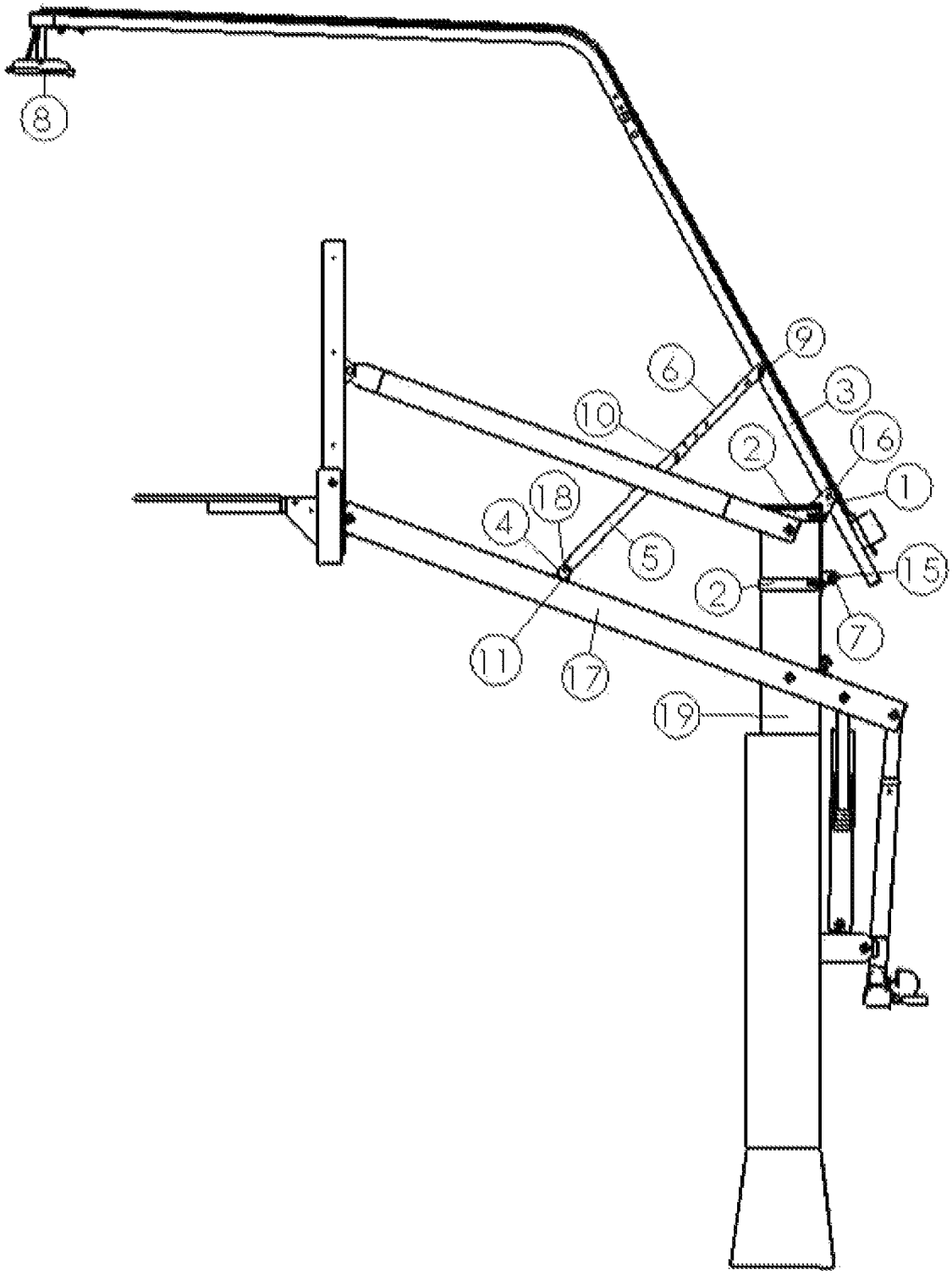
FIG. 2 is the structure diagram for adjusting the height of the basketball stand lighting system.

As shown in FIG. 2, the telescopic frame inner pipe 6 and the main stand 3 may be connected with the twelfth pin 9, so that the telescopic frame inner pipe 6 and the main stand 3 can be relatively moved.

The telescopic frame outer pipe 5 and the telescopic frame inner pipe 6 may be connected with the eighth bolt 10, so that the telescopic frame outer pipe 5 and the telescopic frame inner pipe 6 can relatively slide.

The inclined support frame 4 and the lower support 17 may be connected by the buffer 11, so that the inclined supporting frame 4 and a lower support 17 can be relatively moved.

Figure 3:
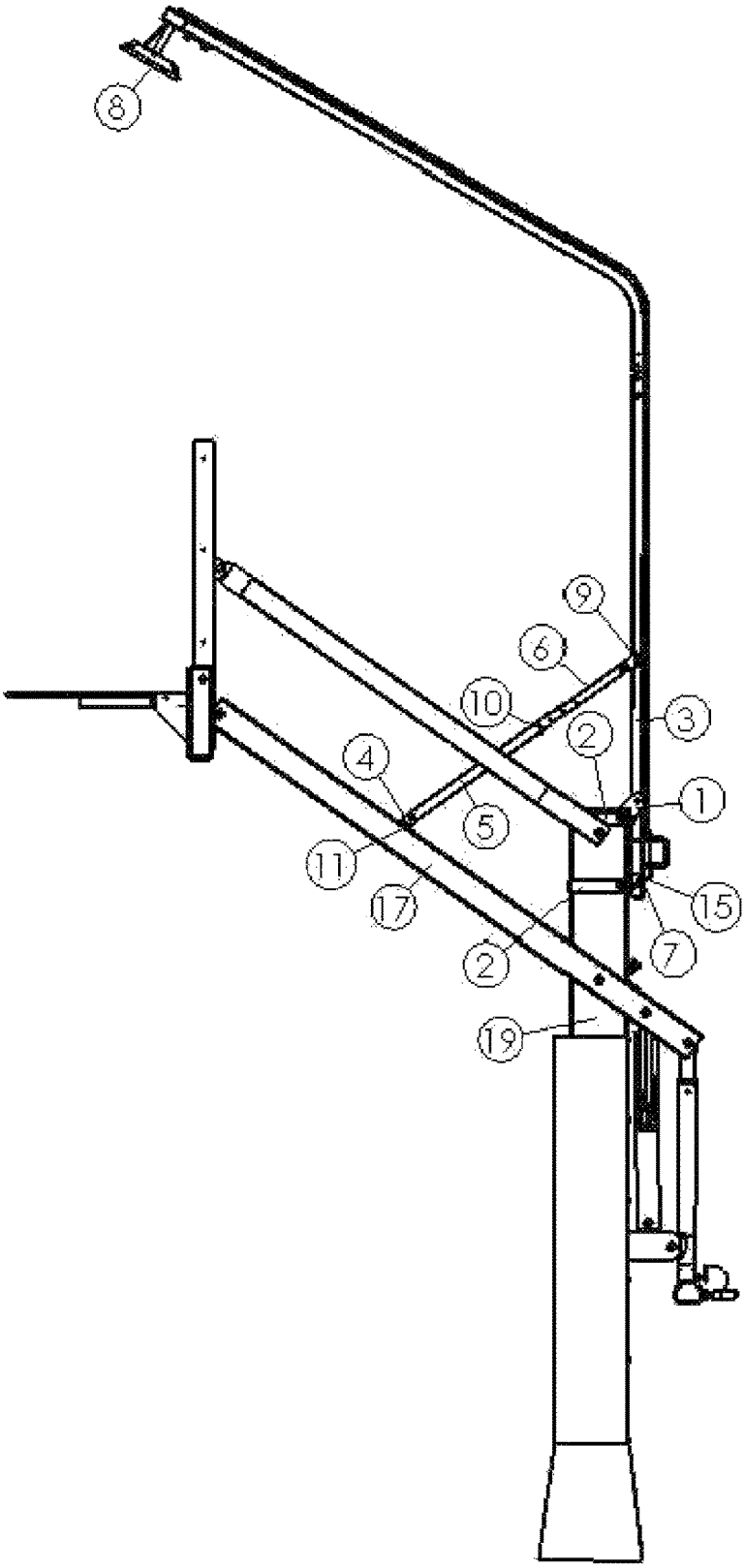
FIG. 3 is a structure diagram of the installed basketball stand lighting system.

As shown in FIG. 3, the frame 3 and a lower fixing plate 7 may be fixedly connected with a M12X25 hex-head bolt 15 and a twelfth gasket 14.

The fixing seat 1 and main stand 3 may be fixedly connected with a M12X110 hex-head bolt 16 and a M12 nylon cap 12.

The inclined support frame 4 and the telescopic frame outer pipe 5 may be fixedly connected with a M10X60 hex-head bolt 18 and a M10 nylon cap 13.

The frame 3 and the illuminating lamp 8 may form the entire basketball lighting system.

Figure 4:
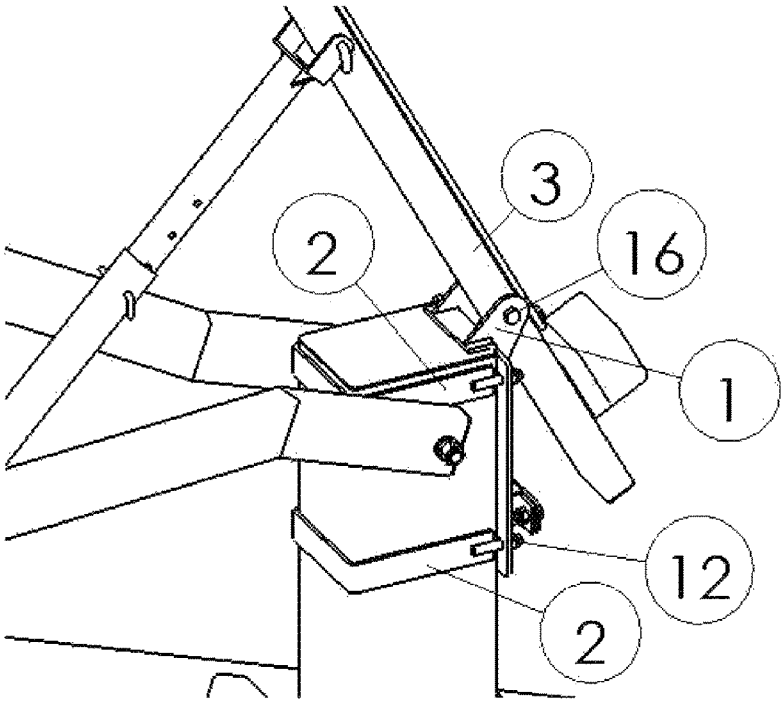
FIG. 4 is a structure diagram of the basketball stand lighting system with the main stand connected with the fixed base.

As shown in FIG. 4, the M12X110 hex-head bolt 16 as a fixed point of the lighting system may ensure the highest position of the basketball stand lighting system, and that the lowest position of the basketball lighting system does not to interfere with other parts.

Figure 5:
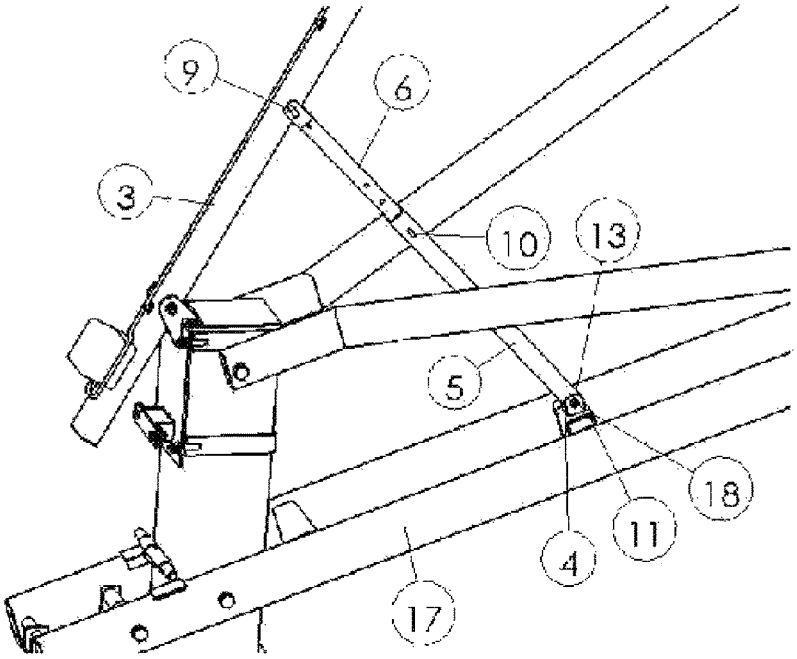
FIG. 5 is a structure diagram of the basketball stand lighting system connected to the telescopic frame outer tube and the telescopic frame inner tube.

As shown in FIG. 5, with the M10X60 hex-head bolt 18 as an inclined supporting point, the inclined support frame 4, the telescopic frame outer pipe 5, and the telescopic frame inner pipe 6 as the telescopic rod structure inclined support, may be connected with the lower support 17 using a loose connection mode. The lower support 17 and the contact surface with the cushion 11 may be protected.

The sloping supports the other end of the quick connection and installation of a lighting system.

Figure 6:
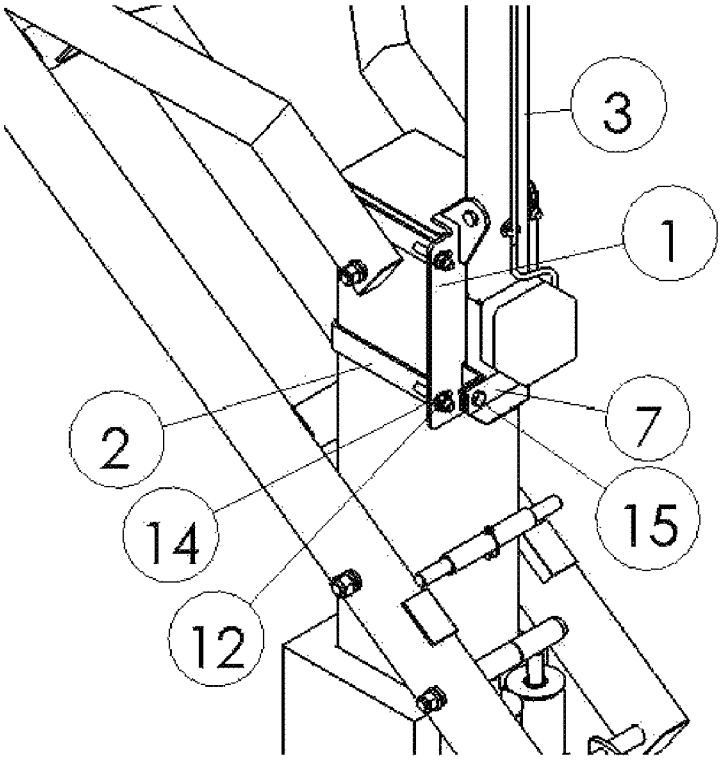
FIG. 6 is a structure diagram of the basketball stand lighting system with the main stand in the vertical position.

As shown in FIG. 6, the connection of the fixing seat 1, the U-shaped supporting structure, and the lower fixing plate 7 to the upper and lower ends of the main stand 3 may be in a fixed manner, where the vertical direction of the upper and lower ends are used to lock the connection.

First, the fixing seat 1 may be connected with the U-shaped fixing frame 2 and the upright column with 19. The main stand 3 may be connected to the fixing seat 1 with a M12X110 hex-head bolt 18. The inclined support frame 4, the telescopic frame outer pipe 5, the telescopic frame inner pipe 6, the main stand 3, and a lower support 24 may be connected with the twelfth pin 9 and the eighth bolt 10.

The height of the basketball goal may be adjusted to adjust the position of the basketball stand lighting system to the vertical position as shown in FIG. 3. The lower fixing plate 7 is fixed with a M12X25 hex-head bolt 15. Then the inclined supporting frame 4, the telescopic frame outer pipe 5 and the telescopic frame inner pipe 6 may be disassembled, and then the basketball stand height adjustment may take place.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A basketball support lighting system, comprising:
a fixing seat;
at least one U-shaped supporting structure;
a main stand;
an inclined support frame;
a telescopic frame outer pipe;
a telescopic frame inner pipe;
a lower fixing plate;
a lighting lamp;
a lower support; and
a column, wherein
the fixing seat is connected with the at least one U-shaped supporting structure and the column, wherein the at least one U-shaped supporting structure comprises two U-shaped supporting structures;
the main stand is connected with the fixing seat and the lower fixing plate;
the telescopic frame outer pipe and the telescopic frame inner pipe are connected together;
the telescopic frame inner pipe is connected with an upper end of the main stand;
the telescopic frame outer pipe is connected with a lower end of the lower support by the inclined support frame; and
the lighting lamp is connected to a front end of the main stand.

2. The basketball support lighting system of claim 1, further comprising
the telescopic frame inner pipe and the main stand connected by a twelfth pin, wherein the telescopic frame inner pipe and the main stand are configured to move;
the telescopic frame outer pipe and the telescopic frame inner pipe connected by an eighth bolt, wherein the telescopic frame outer pipe and the telescopic frame inner pipe are configured to slide; and
the inclined support frame and the lower support connected by a cushion pad, wherein the inclined support frame and the lower support are configured to move.

3. The basketball support lighting system of claim 1, wherein the main stand and the lower
fixing plate are fixedly connected by a M12X25 hex-head bolt.

4. The basketball support lighting system of claim 1, wherein the fixing seat and the main
stand are fixedly connected by a M12X110 hex-head bolt.

5. The basketball support lighting system of claim 1, wherein the inclined support frame and
the telescopic frame outer pipe are fixedly connected by a M10X60 hex-head bolt.

6. The basketball support lighting system of claim 1, wherein the main stand and the lighting
lamp are connected together and configured to form the basketball support lighting system.

7. The basketball support lighting system of claim 4, wherein the M12X110 hex-head bolt is
a fixed point of the basketball support lighting system, the M12X110 hex-head bolt being configured to ensure a highest position of the basketball support lighting system.

8. The basketball support lighting system of claim 5, wherein the M10X60 hex-head bolt is
an inclined supporting point connecting the inclined support frame, the telescopic frame outer pipe, and the telescopic frame inner pipe to the lower support, the telescopic frame inner pipe being a telescopic rod structure inclined support.

9. The basketball support lighting system of claim 1, further comprising the fixing seat, the at least one U-shaped supporting structure, and the lower fixing plate being connected to the upper end and the lower end of the main stand, wherein the upper end and the lower end of the main stand are configured to lock in place.

10. A basketball support lighting system, comprising:
a fixing seat connected to at least one U-shaped supporting structure and a column;
a main stand connected with the fixing seat and a lower fixing plate;
a telescopic frame inner pipe connected with an upper end of the main stand;
a telescopic frame outer pipe connected with the telescopic frame inner pipe;
a lower end of a lower support connected with the telescopic frame outer pipe by an inclined support frame;
a lighting lamp connected to a front end of the main stand; and
a cushion pad connected with the inclined support frame and the lower support, wherein the inclined support frame and the lower support are configured to move.

11. The basketball support lighting system of claim 10, further comprising
the telescopic frame inner pipe and the main stand connected by a twelfth pin, wherein the telescopic frame inner pipe and the main stand are configured to move; and
the telescopic frame outer pipe and the telescopic frame inner pipe connected by an eighth bolt, wherein the telescopic frame outer pipe and the telescopic frame inner pipe are configured to slide.

12. The basketball support lighting system of claim 10, wherein the main stand and the lower fixing plate are fixedly connected by a M12X25 hex-head bolt.

13. The basketball support lighting system of claim 10, wherein the fixing seat and the main stand are fixedly connected by a M12X110 hex-head bolt.

14. The basketball support lighting system of claim 10, wherein the inclined support frame and the telescopic frame outer pipe are fixedly connected by a M10X60 hex-head bolt.

15. The basketball support lighting system of claim 10, wherein the main stand and the lighting lamp are connected together and configured to form the basketball support lighting system.

16. A basketball support lighting system, comprising a fixing seat connected to at least one U-shaped supporting structure and a column;

a main stand connected with the fixing seat and a lower fixing plate, wherein the main stand and the lower fixing plate are fixedly connected by a M12X25 hex-head bolt, the fixing seat and the main stand being fixedly connected by a M12X110 hex-head bolt;

a telescopic frame inner pipe connected with an upper end of the main stand, wherein the telescopic frame inner pipe and the upper end of the main stand are connected by a twelfth pin;

a telescopic frame outer pipe connected with the telescopic frame inner pipe, wherein the telescopic frame outer pipe and the telescopic frame inner pipe are connected by an eighth bolt;

a lower end of a lower support connected with the telescopic frame outer pipe by an inclined support frame, wherein the inclined support frame and the telescopic frame outer pipe are fixedly connected by a M10X60 hex-head bolt;

a lighting lamp connected to a front end of the main stand; and a cushion pad connected with the inclined support frame and the lower support, wherein the inclined support frame and the lower support are configured to move.

* * * * *